US010344418B2

(12) United States Patent
Lee et al.

(10) Patent No.: US 10,344,418 B2
(45) Date of Patent: Jul. 9, 2019

(54) LAUNDRY TREATMENT APPARATUS

(71) Applicant: LG ELECTRONICS INC., Seoul (KR)

(72) Inventors: Jihong Lee, Seoul (KR); Byungjin Lee, Seoul (KR); Hosung Jang, Seoul (KR); Yeongkyeong Choi, Seoul (KR); Minkyu Sang, Seoul (KR)

(73) Assignee: LG Electronics Inc., Seoul (KR)

( * ) Notice: Subject to any disclaimer, the term of this patent is extended or adjusted under 35 U.S.C. 154(b) by 16 days.

(21) Appl. No.: 15/198,008

(22) Filed: Jun. 30, 2016

(65) Prior Publication Data

US 2017/0356117 A1 Dec. 14, 2017

(30) Foreign Application Priority Data

Jun. 30, 2015 (KR) ..... 10-2015-0092776

(51) Int. Cl.

| | |
|---|---|
| ***D06F 37/26*** | (2006.01) |
| ***D06F 37/28*** | (2006.01) |
| ***D06F 39/12*** | (2006.01) |
| ***D06F 37/02*** | (2006.01) |
| ***D06F 39/00*** | (2006.01) |
| *D06F 39/14* | (2006.01) |

(52) U.S. Cl.

CPC ..... *D06F 37/26* (2013.01); *D06F 37/02* (2013.01); *D06F 37/28* (2013.01); *D06F 39/005* (2013.01); *D06F 39/12* (2013.01); *D06F 39/14* (2013.01)

(58) Field of Classification Search

None

See application file for complete search history.

(56) References Cited

U.S. PATENT DOCUMENTS

2002/0056293 A1 5/2002 Kin et al.
2007/0023244 A1 2/2007 Carlson et al.
(Continued)

FOREIGN PATENT DOCUMENTS

CN 1352332 6/2002
CN 101302706 A 11/2008
(Continued)

OTHER PUBLICATIONS

Extended European Search Report issued in European Application No. 16176890.8 dated Aug. 22, 2016, 7 pages.
(Continued)

*Primary Examiner* — Jason Y Ko
*Assistant Examiner* — Cristi J Tate-Sims
(74) *Attorney, Agent, or Firm* — Fish & Richardson P.C.

(57) ABSTRACT

A laundry treatment apparatus includes a cabinet having an opening, a drawer configured so as to be discharged from the cabinet through the opening, a through-hole formed in an upper surface of the drawer, a tub that is located inside the drawer and that defines a space that is configured to receive water, an introduction aperture formed in an upper surface of the tub, the introduction aperture being located under the through-hole, a drum that is located in the tub, that is configured to rotate, and that is configured to receive laundry, a door that is configured to open and close the introduction aperture, the door being coupled to one of the drawer or the tub, and a guide for preventing the door from interfering with the opening when the drawer is discharged from the cabinet.

20 Claims, 8 Drawing Sheets

(56) References Cited

U.S. PATENT DOCUMENTS

| | | | | |
|---|---|---|---|---|
| 2008/0072631 | A1 | 3/2008 | Je et al. | |
| 2008/0256721 | A1 | 10/2008 | Kim et al. | |
| 2009/0139276 | A1* | 6/2009 | Kim | D06F 23/02 68/17 R |
| 2010/0307200 | A1* | 12/2010 | Jeong | D06F 31/00 68/13 R |
| 2012/0068587 | A1* | 3/2012 | Pantoja | A47B 81/00 312/242 |
| 2014/0319983 | A1* | 10/2014 | Park | A47B 96/00 312/228 |

FOREIGN PATENT DOCUMENTS

| | | | | |
|---|---|---|---|---|
| CN | 101617077 | | 12/2009 | |
| CN | 101694052 | A | 4/2010 | |
| CN | 102844486 | | 12/2012 | |
| EP | 1785083 | A2 * | 5/2007 | A47L 15/0021 |
| EP | 1900868 | A1 * | 3/2008 | D06F 58/24 |
| EP | 1900868 | | 2/2011 | |
| EP | 2700743 | | 2/2014 | |
| EP | 1785083 | | 4/2014 | |
| FR | 2923844 | | 5/2009 | |
| JP | 2001509055 | A | 7/2001 | |
| JP | 2003529028 | A | 9/2003 | |
| KR | 10-0400448 | | 10/2003 | |
| WO | 01/26532 | | 4/2001 | |
| WO | 2008/069607 | | 6/2008 | |

OTHER PUBLICATIONS

International Search Report and Written Opinion in International Application No. PCT/KR2016/007026, dated Sep. 30, 2016, 18 pages.

Chinese Office Action in Chinese Application No. 201610512207.6, dated Feb. 5, 2018, 17 pages.

Taiwan Office Action in Taiwan Application No. 105119000, dated Jun. 26, 2017, 19 pages (with English translation).

* cited by examiner

LAUNDRY TREATMENT APPARATUS

CROSS REFERENCE TO RELATED APPLICATION

This application claims the benefit of Korean Patent Application No. 10-2015-0092776, filed on Jun. 30, 2015, which is hereby incorporated by reference as if fully set forth herein.

FIELD

The present disclosure relates to a laundry treatment apparatus.

BACKGROUND

Generally, a laundry treatment apparatus is a generic term for an apparatus that washes laundry (e.g. objects to be washed or objects to be dried), an apparatus that dries laundry, and an apparatus that may perform both washing and drying of laundry.

Conventional laundry treatment apparatuses are classified into front loading type laundry treatment apparatuses configured such that laundry is introduced through an introduction aperture formed in the front surface of the apparatus, and top loading type laundry treatment apparatuses configured such that laundry is introduced through an introduction aperture formed in the upper surface of the apparatus.

A top loading type laundry treatment apparatus may include a cabinet, a tub provided inside the cabinet and having an introduction aperture in the upper surface thereof, a drum rotatably provided inside the tub, and a door for opening and closing the introduction aperture.

SUMMARY

One object of the subject matter described in this application is to provide a laundry treatment apparatus, which may allow a drawer to be discharged from a cabinet even if a door to open an introduction aperture is opened in the state in which the drawer is inserted into the cabinet.

In addition, another object of the subject matter described in this application is to provide a laundry treatment apparatus, which may notify a user that a door to open an introduction aperture is opened even though a drawer is inserted into a cabinet.

In addition, another object of the subject matter described in this application is to provide a laundry treatment apparatus, which may determine whether or not a drawer is inserted into a cabinet and may notify a user of the result of the determination.

In addition, another object of the subject matter described in this application is to provide a laundry treatment apparatus, which includes a sealing unit having a good effect of hermetically sealing an introduction aperture.

In addition, another object of the subject matter described in this application is to provide a laundry treatment apparatus, which may prevent damage to a door when a drawer is discharged from a cabinet in the state in which the door is opened.

In addition, another object of the subject matter described in this application is to provide a laundry treatment apparatus, which may prevent a door from being incorrectly determined to be opened due to, for example, external signals, such as vibration.

In addition, another object of the subject matter described in this application is to provide a laundry treatment apparatus, which may accurately sense whether or not a door to open an introduction aperture is opened using magnetic force.

In addition, a further object of the subject matter described in this application is to provide a laundry treatment apparatus, which may accurately determine the occurrence of abnormalities in constituent elements for determining whether or not a door to open an introduction aperture is opened.

According to one aspect, a laundry treatment apparatus includes a cabinet having an opening, a drawer configured so as to be discharged from the cabinet through the opening, a through-hole formed in an upper surface of the drawer, a tub that is located inside the drawer and that defines a space that is configured to receive water, an introduction aperture formed in an upper surface of the tub, the introduction aperture being located under the through-hole, a drum that is located in the tub, that is configured to rotate, and that is configured to receive laundry, a door that is configured to open and close the introduction aperture, the door being coupled to one of the drawer or the tub, and a guide for preventing the door from interfering with the opening when the drawer is discharged from the cabinet.

Implementations according to this aspect may include one or more of the following features. For example, the guide may include a wheel that is located inside the cabinet and that is configured to rotate, and a distance from the upper surface of the drawer to a lowermost end of the wheel may be shorter than a distance from the upper surface of the drawer to the uppermost end of the front opening. The drawer may include a drawer body that is located inside the cabinet and that defines a space that is configured to receive the tub and further a drawer panel that is configured to open and close the opening for discharging the drawer body from the cabinet, and the opening may include an opening formed in one surface of the cabinet for insertion of the drawer body, and a flange for preventing the drawer panel from being inserted into the cabinet. In some cases, the guide may be configured to prevent interfering contact between the door and the flange. The guide may include a case that is fixed to the cabinet, and a wheel that is located in the case and that is configured to rotate, and a distance from an upper surface of the drawer body to a lowermost end of the wheel may be shorter than a distance from the upper surface of the drawer body to the flange. The wheel may include a first wheel and a second wheel that are spaced apart from each other by a predetermined distance in a direction along which the drawer body is discharged.

In some implementations, the laundry treatment apparatus may further include a position sensing unit that is configured to determine one or both of: whether the drawer is inserted into the cabinet to a predetermined reference position; and whether the door is opened during a state in which the drawer is inserted into the cabinet. The position sensing unit may include a first magnetic-force generator that is configured to generate magnetic force and that is located in one of the cabinet or the door, and a first magnetic-force sensor that is configured to sense a magnitude of the magnetic force generated by the first magnetic-force generator and that is located in the other of the cabinet and the door. The position sensing unit may include a first magnetic-force sensor that is configured to sense magnetic force and that is located inside the cabinet, a body that is located inside the cabinet and that is configured to be rotated toward the first magnetic-force sensor based on the door being opened, and a first magnetic-force generator that is configured to generate magnetic force and that is coupled to the rotating body. In some cases, the position sensing unit may include a first magnetic-force sensor that is configured to sense magnetic force and that is located inside the cabinet, a body that is located inside the cabinet and that is configured to be rotated away from the first magnetic-force sensor based on the door being opened, and a first magnetic-force generator that is configured to generate magnetic force and that is coupled to the rotating body. The drawer may include a drawer body that is located inside the cabinet and that defines a space that is configured to receive the tub, and further includes a drawer panel that is configured to open and close the opening for discharging the drawer body from the cabinet, and the position sensing unit may be configured to determine whether opening is closed by the drawer panel. The position sensing unit may include a second magnetic-force generator that is configured to generate magnetic force and that is located in one of the cabinet or the drawer, and a second magnetic-force sensor that is configured to sense a magnitude of the magnetic force generated by the second magnetic-force generator and that is located in the other of the cabinet or the drawer.

In some cases, the laundry treatment apparatus may further include a display unit that is configured to notify a user that the drawer is inserted into the cabinet but not at the reference position, or that the door is opened during a state in which the drawer is inserted into the cabinet, or both. The display unit may be configured to display characters or symbols, configured to generate sound, or configured to emit light. The display unit may be an LCD. The display unit may be a speaker. The display unit may be a lamp. In some cases, based on the drawer being inserted into the cabinet, a distal end of the door may be positioned vertically lower than a rotating shaft of the wheel. A first distance from the upper surface of the drawer body to a lowermost end of the first wheel may be different than a second distance from the upper surface of the drawer body to a lowermost end of the second wheel. The second wheel may be positioned closer to the front opening than the first wheel, and the second distance may be shorter than the first distance.

DETAILED DESCRIPTION

Figure 1:
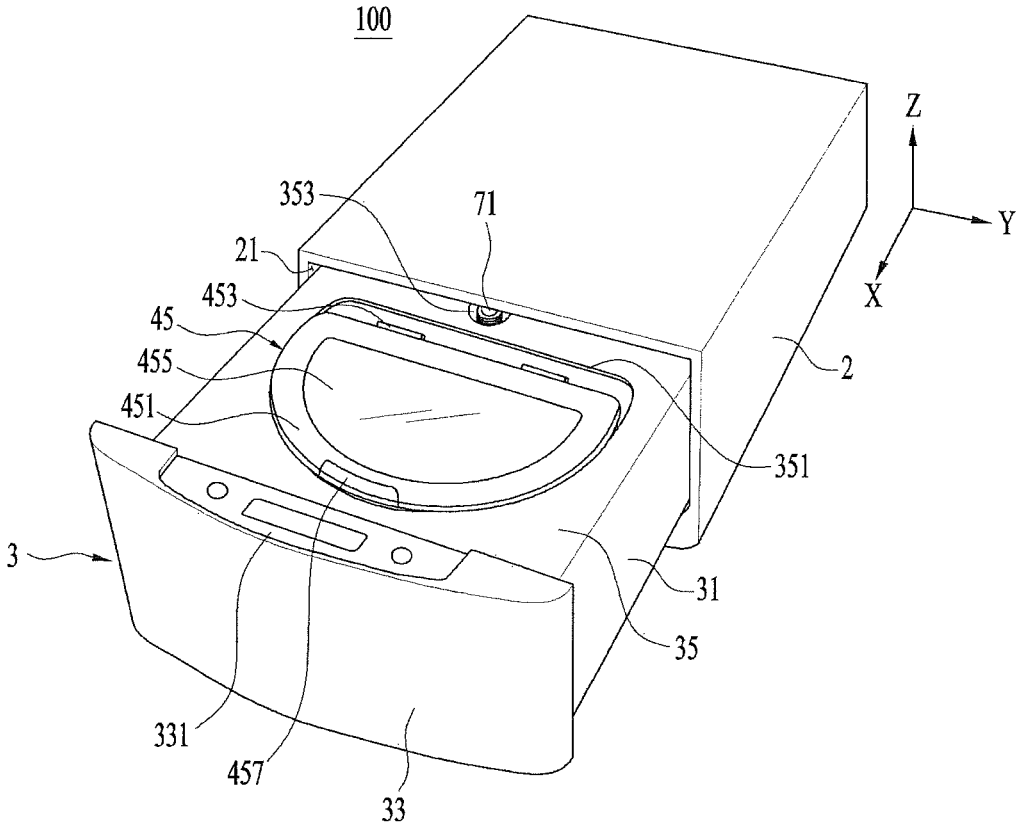
FIGS. 1 and 2 are views showing an example laundry treatment apparatus.
Figure 2:
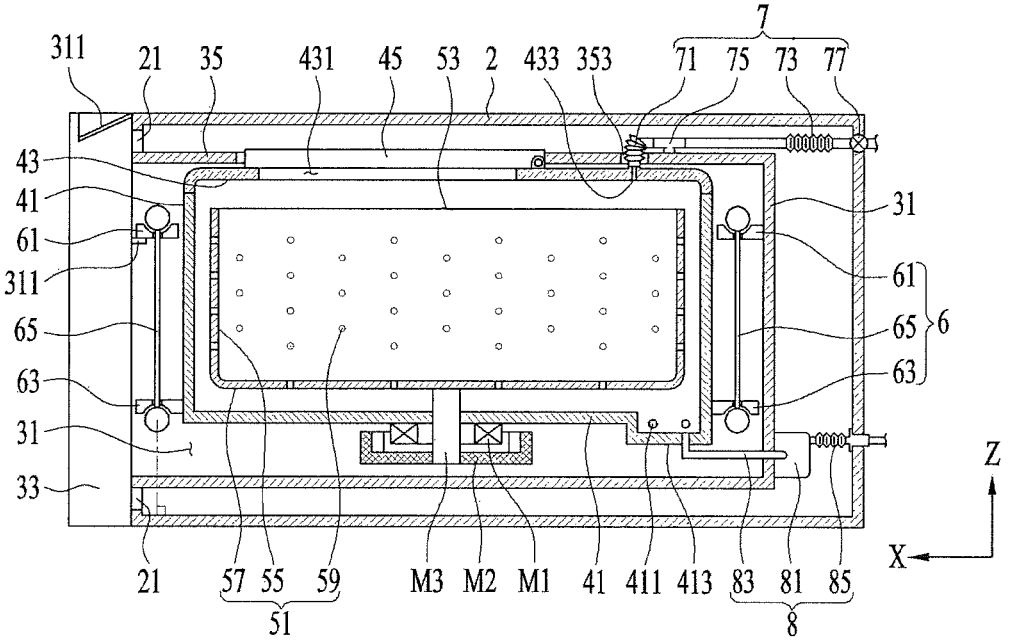

Referring to FIGS. 1 and 2, a laundry treatment apparatus 100 includes a cabinet 2, a drawer 3 provided so as to be discharged from the cabinet 2, a tub 4 provided inside the drawer 3 for storing water therein, and a drum 5 rotatably provided inside the tub 4 for storing laundry therein.

The cabinet 2 may serve to define the external appearance of the laundry treatment apparatus 100, and may also simply serve as a space in which the drawer 3 is received. In any case, the cabinet 2 may be provided in the front surface thereof with an introduction/discharge opening(an opening) 21 for the insertion of the drawer 3.

The introduction/discharge opening(an opening) 21 may include an opening 211 formed in one surface of the cabinet 2, and a flange 213 provided along the edge of the opening 211.

The drawer 3 includes a drawer body 31 configured so as to be inserted into the cabinet 2 through the introduction/discharge opening(an opening) 21, a drawer panel 33 fixed to the front surface of the drawer body 31 for opening and closing the opening 211, and a drawer cover 35 for forming the upper surface of the drawer body 31.

Because the drawer panel 33 is fixed to the front surface of the drawer body 31, the drawer panel 33 may serve as a handle for discharging the drawer body 31 from the cabinet 2.

Once the drawer panel 33 has moved to the position at which the opening 211 is closed by the drawer panel 33, the drawer panel 33 may come into contact with the flange 213. Accordingly, the flange 213 serves not only to arrange the drawer body 31 at a reference position, which is set inside the cabinet 2, but also to prevent the drawer panel 33 from being inserted into the cabinet 2.

The drawer panel 33 may be provided with a control panel 331, which is used to input a control command associated with the operation of the laundry treatment apparatus 100 and to notify a user of a message associated with the operation of the laundry treatment apparatus 100. The control panel 331 may include an input unit 331*a* for the input of a control command, and a display unit 331*b* for displaying signals associated with the operation of the laundry treatment apparatus 100 including the control command. The display unit 331*b* may be at least one selected from among a device for displaying characters or symbols (e.g. an LCD), a device for generating sound (e.g. a speaker), and a device for emitting light (e.g., a lamp).

The drawer body 31 may have any shape so long as it can be inserted into the cabinet 2 through the opening 211 and so long as it can provide a space in which the tub 4 is received. FIG. 1 illustrates the drawer body 31 having a hexahedral shape by way of example.

The drawer cover 35 has a first through-hole 351 and a second through-hole 353 for communicating the inside of the drawer body 31 with the outside. The first through-hole 351 must be provided for the introduction and discharge of laundry, and the second through-hole 353 must be provided to supply water required to wash the laundry. A detailed description related thereto will follow.

As illustrated in FIG. 2, the tub 4 includes a tub body 41 located inside the drawer body 31 for storing water therein, and a tub cover 43 for forming the upper surface of the tub body 41. The tub body 41 may take the form of a cylinder having an open upper surface.

The tub cover 43 may have an introduction aperture 431 for communicating the inside of the tub body 41 with the outside of the tub body 41, and a supply aperture 433 for introducing water into the tub body 41.

The introduction aperture 431 may be provided under the first through-hole 351 provided in the drawer cover 35, and the supply aperture 433 may be provided so as to communicate with the second through-hole 353 provided in the drawer cover 35.

The introduction aperture 431 serves to allow laundry to be introduced into the tub body 41, or to allow the laundry inside the tub body 41 to be discharged to the outside of the tub body 41. The introduction aperture 431 is opened and closed by a door 45, which is rotatably provided on any one of the drawer cover 35 or the tub cover 43.

Figure 3:
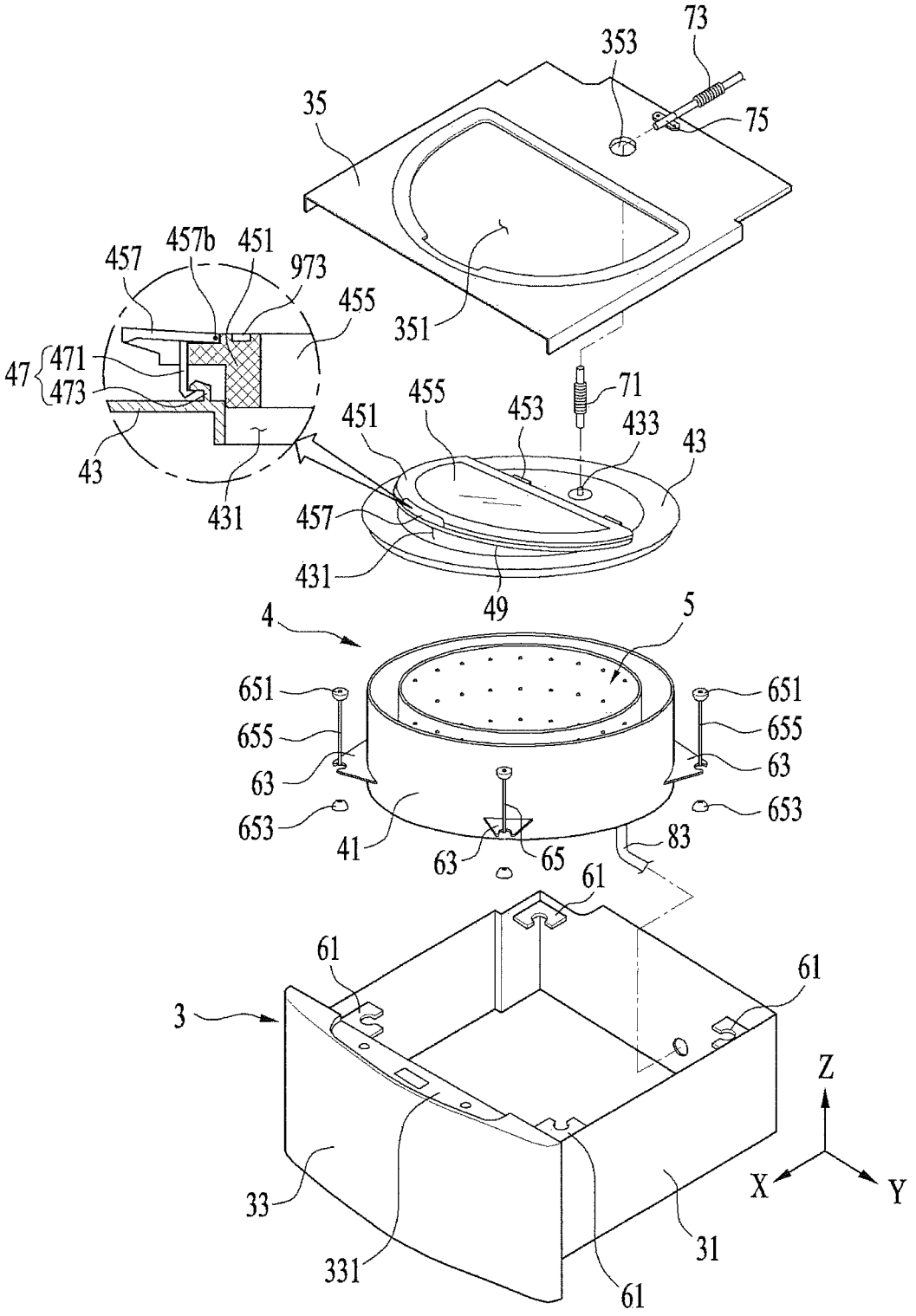
FIG. 3 is a view showing an example coupling structure of a drawer, a tub, and a drum.

FIG. 3 illustrates the case where the door 45 is coupled to the tub cover 43. In this case, the door 45 may include a frame 451 rotatably coupled to the tub cover 43 via a hinge 453, a window 455 provided in the frame 451, and a handle 457 for separably coupling the frame 451 to the tub cover 43.

The window 455 may be formed of a transparent material to allow the user to view the inside of the tub body 41 when the drawer 3 is discharged from the cabinet 2.

Figure 4A:
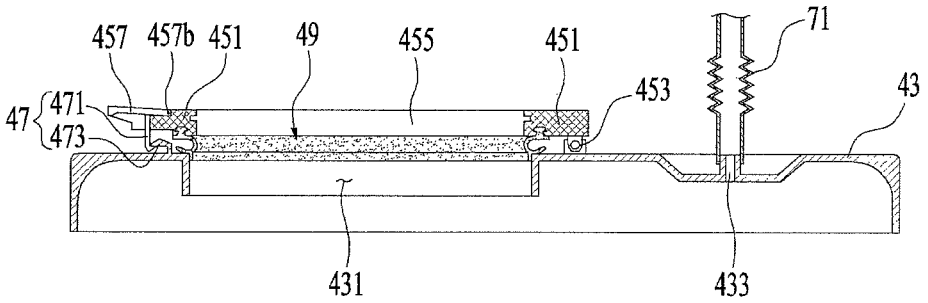
FIGS. 4(*a*) and 4(*b*) are views showing an example sealing unit.
Figure 4B:
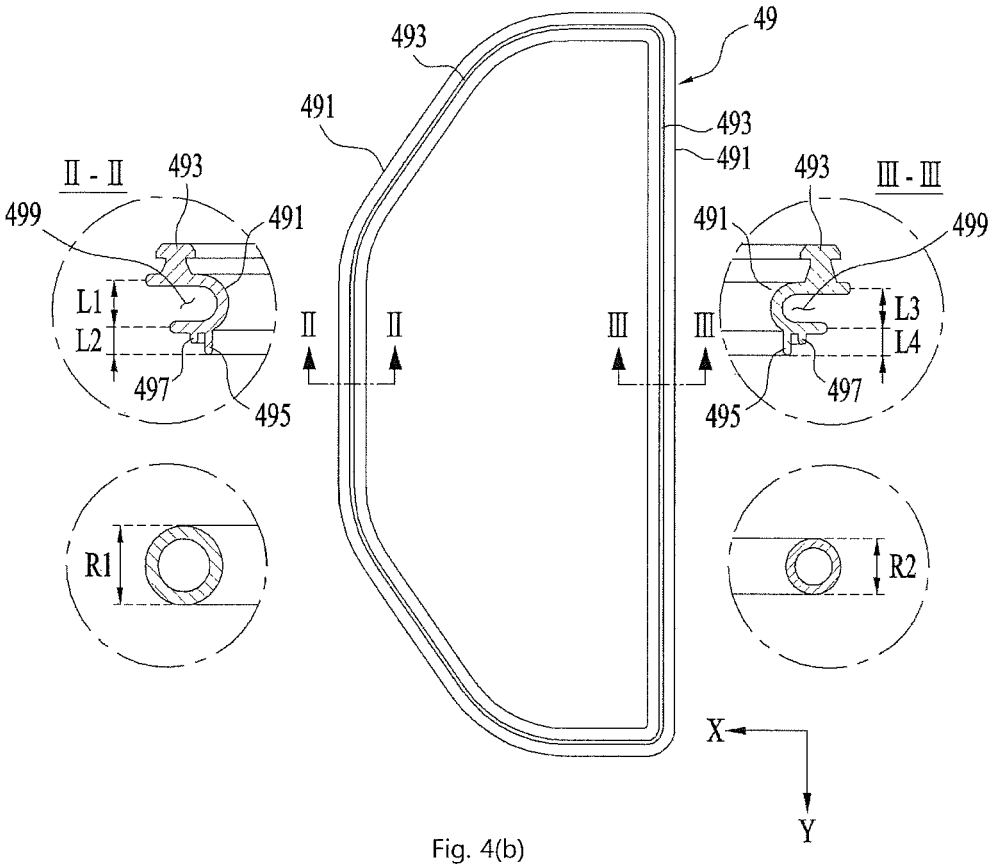

As illustrated in FIGS. 4(*a*) and 4(*b*), the handle 457 is rotatably coupled to the frame 451 via a handle shaft 457*b*, and the handle 457 is separably fixed to the tub cover 43 via a fixing unit 47.

The fixing unit 47 may include a first fastening portion 471 (e.g. a hook) protruding from any one of the handle 457 and the tub cover 43, and a second fastening portion 473 (e.g. a hook receiving recess) formed in the other one of the handle 457 and the tub cover 43 for separably receiving the first fastening portion 471.

In order to prevent the water inside the tub body 41 from being discharged to the outside of the tub body 41 through the introduction aperture 431, any one of the frame 451 and the tub cover 43 may be provided with a sealing unit 49 for hermetically sealing a space between the frame 451 and the introduction aperture 431 when the door 45 to open the introduction aperture 431 is closed.

The sealing unit 49 provided may include a sealing body 491 fixed to the frame 451 so as to hermetically seal the space between the frame 451 and the edge of the introduction aperture 431, and an insertion portion 495 extending from the sealing body 491 so as to be inserted into the introduction aperture 431.

The sealing body 491 may take the form of a hollow bar, or may have a C-shaped cross section. In any case, the sealing body 491 may be formed of an elastic material, such as rubber.

In the case where the introduction aperture 431 has a closed-curve shape (e.g. a circular, oval, or polygonal shape) and the sealing body 491 has a hollow bar shape, the sealing body 491 must inevitably have an adhesive surface. The sealing body having a hollow bar shape (e.g. a sealing body having an O-shaped cross section) must be manufactured only into a linear shape. Therefore, in order to provide the sealing body 491 having a hollow bar shape with a closed-curve shape, the sealing body having an O-shaped cross section must be cut to a prescribed length, and both ends of the sealing body must be attached to each other using, for example, an adhesive.

However, when a portion of the sealing body 491 is attached using an adhesive, the portion attached using the adhesive and a remaining portion have different elasticities, which may cause deterioration in the effect of the sealing unit 49. Therefore, the sealing unit 49 provided may have a C-shaped cross section, rather than an O-shaped cross section.

That the sealing body 491 has a C-shaped cross section means that the cross section of the sealing body 491 does not form a closed-curve. That is, the sealing body 491 attains a C-shaped cross section because the inside and the outside of the sealing body 491 communicate with each other through an opening 499.

The opening 499 may be provided in one of the surfaces of the sealing body 491, which is located opposite to the direction in which the introduction aperture 431 is located. Assuming that the opening 499 is located so as to face the introduction aperture 431, wash water remaining on the door 45 may remain in the opening 499, rather than moving to the tub 4, when the door 45 is opened.

In addition, when the sealing body 491 has a C-shaped cross section, the sealing body 491, which has the same closed-curve shape as the shape of the introduction aperture 431, may be formed without adhesion even if the introduction aperture 431 has the closed curve shape, which may prevent any problem caused by the sealing body 491 having the adhesive surface.

When the sealing body 491 has a C-shaped cross section, a distance L1 between free ends of the sealing body 491, located in the direction in which the fixing unit 47 of the handle 457 is provided, may be longer than a distance L3 between free ends of the sealing body 491 located in the direction in which the hinge 453 is provided. This serves to improve the convenience of a user by causing the door 45 to be separated from the introduction aperture 431 once the user has separated the fixing unit 47.

When the sealing body 491 has an O-shaped cross section, the above-described effect may be realized by configuring the sealing body 491 such that a diameter R1 of a portion of the sealing body 491, located in the direction in which the fixing unit 47 of the handle 457 is provided, is longer than a diameter R2 of a portion of the sealing body 491 is located in the direction in which the hinge 453 is provided.

The sealing body 491 having the configuration described above may be coupled to the frame 451 of the door 45 via a body fixing portion 493.

The insertion portion 495 may have any shape so long as it can be inserted into the introduction aperture 431 so as to increase the efficiency of sealing of the introduction aperture 431. A length L4 of a portion of the insertion portion 495, provided in a region parallel to the hinge 453, may be longer than a length L2 of a remaining portion of the insertion portion 495. This serves to allow water remaining on the door 45 to be introduced into the tub body 41 through the introduction aperture 431 when the door 45 to open the introduction aperture 431 is opened.

In addition, the sealing unit 49 may further include a protrusion 497 for causing the insertion portion 495 to come into close contact with the introduction aperture 431 when the sealing body 491 is pushed toward the introduction aperture 431. To this end, the protrusion 497 may be provided on the sealing body 491 at a position between the insertion portion 495 and the free ends located on a lower portion of the sealing body 491.

The tub 4 having the configuration described above is coupled to the drawer body 31 via a tub support unit 6. As illustrated in FIG. 2, the tub support unit 6 may include a first support member 61 provided at the drawer body 31, a second support member 63 provided at the tub body 41, and a connector 65 for connecting the first support member 61 and the second support member 63 to each other.

The connector 65 may include a first connection piece 651 configured so as to be seated in the first support member 61, a second connection piece 653 for supporting the second support member 63, and a bar 655 for connecting the first connection piece 651 and the second connection piece 653 to each other.

The first connection piece 651 may be shaped so as to be movable in the first support member 61 while being seated in the first support member 61. The second connection piece 653 may be shaped so as to support the second support member 63 and to be movable in the second support member 63.

FIG. 2 illustrates the case where the first connection piece 651 and the second connection piece 653 have a spherical shape by way of example, and FIG. 3 illustrates the case where the first connection piece 651 and the second connection piece 653 have a semispherical surface in contact with the respective support members 61 and 63 by way of example.

As illustrated in FIG. 2, the bar 655 may form a right angle with respect to the bottom surface of the cabinet 2 (i.e. provided parallel to the height direction Z of the cabinet 2 or provided so as to form a right angle with respect to the bottom surface of the drawer 3).

In some cases, because at least three tub support units 6 are provided to couple the tub body 41 to the drawer body 31 and the bars 655 form a right angle with respect to the bottom surface of the cabinet 2, the distance between the tub cover 43 and the drawer cover 35 may be increased compared to the case where the bars 655 are tilted by a prescribed angle relative to the Z-axis.

Accordingly, the tub support units 6 may reduce the possibility of the tub cover 43 colliding with the drawer cover 35 even if the tub body 41 vibrates inside the drawer body 31.

When the bars 655 are provided so as to form a right angle with respect to the bottom surface of the drawer 3, at least one of the first support member 61 and the second support member 63 may be separably coupled to the drawer body 31.

When at least three tub support units 6 are provided and both the first support member 61 and the second support member 63 are not separable from the drawer body 31, a worker who attempts to fix the tub body 41 to the drawer body 31 first needs to insert the tub body 41 into the drawer body 31 so as to prevent the first support member 61 from interfering with the second support member 63, and thereafter needs to rotate the tub body 41 so that the second support member 63 is located on the vertical axis, which passes through the first support member 61, in order to couple the first connection piece 651 to the first support member 61.

Although the feature by which the bar 655 of the tub support unit 6 is provided so as to form a right angle with respect to the bottom surface of the drawer 3 serves to minimize the distance between the outer circumferential surface of the tub body 41 and the inner circumferential surface of the drawer body 31 so as to minimize the volume of the laundry treatment apparatus 100, the strength of assembly of the first connection piece 651 and the first support member 61 may be deteriorated while the process described above is performed. This problem may be solved by making the first support member 61 be separable from the drawer body 31.

The drum 5, which is provided inside the tub 4, may include a cylindrical drum body 51 having an opening 53 (i.e. a drum opening) formed in the upper surface thereof. Because the drum opening 53 is located below the introduction aperture 431, the laundry supplied through the introduction aperture 431 may be supplied to the drum body 51 through the drum opening 53. A plurality of drum through-holes 59 may be provided in a bottom surface 57 and a circumferential surface 55 of the drum body 51 for communicating the inside of the drum body 51 with the tub body 41.

The drum body 51 may be rotated inside the tub body 41 by a drive unit. The drive unit may include a stator M1 located outside the tub body 41 and fixed to the bottom surface of the tub body 41, a rotor M2 configured so as to be rotated by a rotating magnetic field provided by the stator M1, and a rotating shaft M3 penetrating the bottom surface of the tub body 41 for connecting the bottom surface 57 of the drum 5 and the rotor M3 to each other. In this case, the rotating shaft M3 may be provided so as to form a right angle with respect to the bottom surface of the tub body 41.

The laundry treatment apparatus 100 having the configuration described above may supply water to the tub 4 via a water supply unit 7, and may discharge water stored in the tub 4 to the outside of the cabinet 2 via a drain unit 8.

As illustrated in FIG. 2, the water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the tub cover 43 for connecting the first water supply pipe 71 and the second water supply pipe 73 to each other.

The first water supply pipe 71 may connect the supply aperture 433 and the connection pipe 75 to each other through the second through-hole 353 provided in the drawer cover 35. The first water supply pipe 71 may be a corrugated pipe in order to prevent the first water supply pipe 71 from being separated from the connection pipe 75 when the tub 4 vibrates (see FIG. 3).

In addition, the second water supply pipe 73 may also be a corrugated pipe in order to prevent the second water supply pipe 73 from being separated from the connection pipe 75 when the drawer 3 is discharged from the cabinet 2. The second water supply pipe 73 may be opened and closed by a water supply valve 77, which may be controlled by a controller.

In some cases, the water supply unit 7 may include a single water supply pipe for connecting a water supply source, which is located at the outside of the cabinet 2, to the supply aperture 433 provided in the tub cover 43. In this case, the water supply pipe may be a corrugated pipe.

The drain unit 8 may include a drain pump 81 fixed to the drawer body 31, a first drain pipe 83 for guiding water inside the tub body 41 to the drain pump 81, and a second drain pipe 85 for guiding water discharged from the drain pump 81 to the outside of the cabinet 2. In this case, the second drain pipe 85 may be a corrugated pipe.

In the laundry treatment apparatus 100 having the configuration described above, it may be difficult to discharge the drawer 3 from the cabinet 2 when the door 45 is opened in the state in which the drawer 3 is located inside the cabinet 2. That is, once the door 45 has been opened inside the cabinet 2, the door 45 may interfere with the introduction/discharge opening(an opening) 21 of the cabinet 2 when the drawer 3 is discharged from the cabinet 2, thereby preventing the discharge of the drawer 3.

In order to solve the problem described above, the laundry treatment apparatus 100 may further include a guide 95 for preventing the door 45 from interfering with the introduction/discharge opening(an opening) 21 when the drawer 3 is discharged from the cabinet 2.

Figure 5:
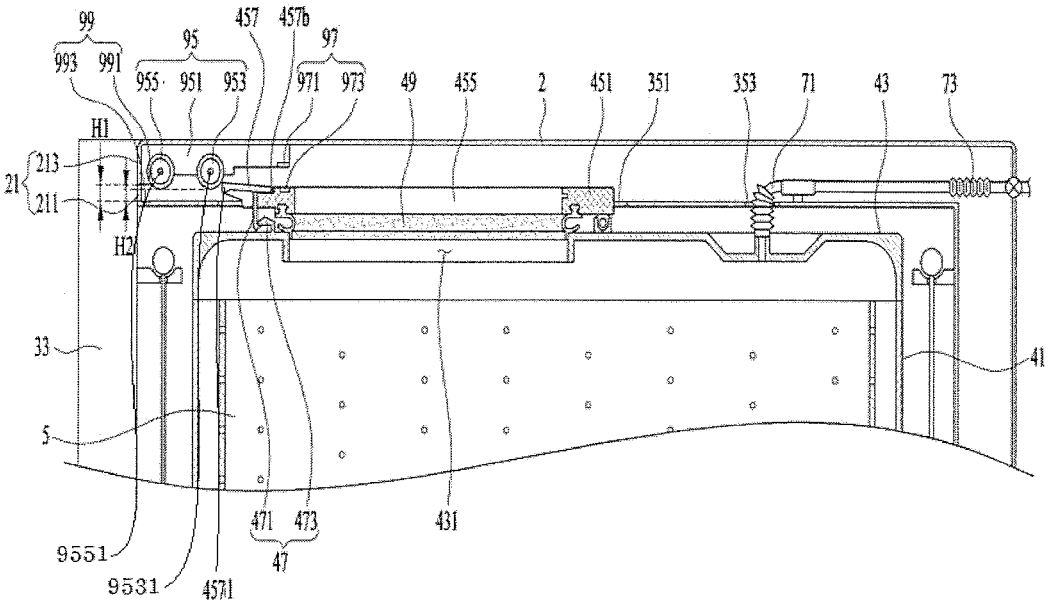
FIGS. 5 and 6 are views showing an example guide.

As illustrated in FIG. 5, the guide 95 may include one or more wheels 953 and 955 rotatably provided inside the cabinet 2. In this case, a distance H2 from the upper surface of the drawer 3 to the lowermost end of the wheels 953 and 955 may be shorter than a distance H1 from the upper surface of the drawer 3 to the introduction/discharge opening(an opening) 21.

The wheels 953 and 955 may be rotatably fixed to the cabinet 2, or may be rotatably fixed to a case 951, which is fixed to the cabinet 2.

In the case where the introduction/discharge opening(an opening) 21 has the opening 211 and the flange 213, the guide 95 needs to prevent the door 45 from interfering with the flange 213 when the drawer 3 is discharged from the cabinet 2. In this case, the distance H2 from the drawer cover 35 to the lowermost end of the wheels 953 and 955 may be shorter than a distance from the drawer cover 35 to the flange 213.

As illustrated in FIG. 5, once the drawer 3 has been inserted into the cabinet 2, a distal end 4571 of the door 45 may be located lower than rotating shafts 9531 and 9551 of the wheels 953 and 955. In addition, the distal end 4571 of the handle 457 may be located lower than the rotating shaft 9531 of the wheel 953.

Figure 6:
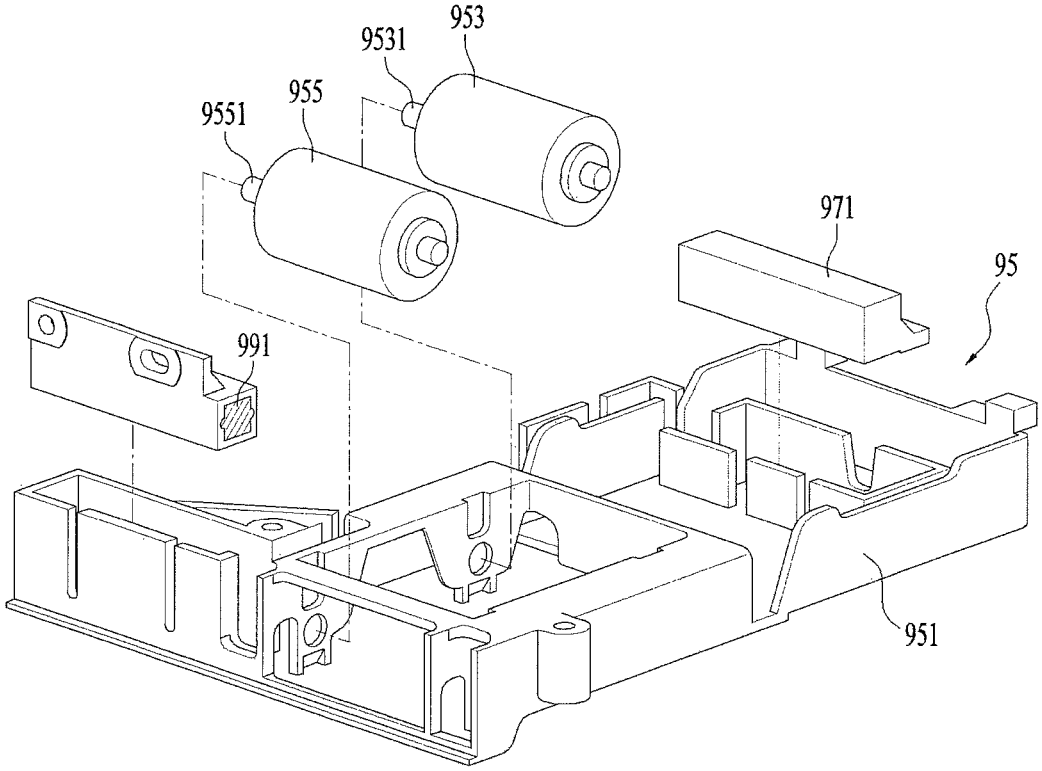

As illustrated in FIG. 6, the wheels may include a first wheel 953 and a second wheel 955, which are spaced apart from each other by a prescribed distance in a direction in which the drawer 3 is discharged. The first wheel 953 may be rotatably fixed to the case 951 via a first shaft 9531, and the second wheel 955, which is located close to the introduction/discharge opening(an opening) 21, may be rotatably fixed to the case 951 via a second shaft 9551.

The distances from the upper surface of the drawer 3 to the lowermost ends of the respective wheels 953 and 955 may be set to the same value, or may be set to different values. In the latter case, the distance from the upper surface of the drawer 3 to the lowermost end of the second wheel 955 (i.e. the wheel located close to the introduction/discharge opening(an opening) 21) may be shorter than the distance from the upper surface of the drawer 3 to the lowermost end of the first wheel 953.

In addition, the distance from the upper surface of the drawer 3 to the lowermost end of the first wheel 953 may be set to a length for enabling the coupling of the first fastening portion 471 and the second fastening portion 473 provided in the fixing unit 47. This serves to eliminate a problem in which the door 45 prevents the drawer 3 from being discharged from the cabinet 2 by fixing the door 45 to the tub cover 43 using the guide 95 whenever the drawer 3 is discharged from or inserted into the cabinet 2.

When the door 45 is opened inside the cabinet 2 so as to open the introduction aperture 431, water inside the tub body 41 may be discharged from the tub body 41 through the introduction aperture 431. To prevent the occurrence of this problem, a first position sensing unit 97 for determining whether or not the door 45 to open the introduction aperture 431 is opened may be included.

The first position sensing unit 97 may include a first magnetic-force generator 973 provided in any one of the cabinet 2 and the door 45 for generating magnetic force, and a first magnetic-force sensor 971 provided in the other one of the cabinet 2 and the door 45 for sensing the magnitude of magnetic force provided by the first magnetic-force generator 973.

FIG. 5 illustrates the case where the first magnetic-force generator 973 is a permanent magnet fixed to the door 45 and the first magnetic-force sensor 971 is fixed to the case 951 so as to sense the magnitude of magnetic force of the permanent magnet by way of example.

In the laundry treatment apparatus 100 having the first position sensing unit 97, when the magnitude of magnetic force sensed by the first magnetic-force sensor 971 is below a predetermined first reference magnetic force, the controller may determine that the drawer 3 is located inside the cabinet 2 and the door 45 to open the introduction aperture 431 is closed.

However, when the magnitude of magnetic force sensed by the first magnetic-force sensor 971 is the predetermined first reference magnetic force or more, the controller may determine that the door 45 located inside the cabinet 2 to open the introduction aperture 431 is opened.

Upon determining that the door 45 to open the introduction aperture 431, located inside the cabinet 2, is opened, the controller may notify the user that the door 45 inside the cabinet 2 is opened via, for example, the display unit 331*b* (using character signals, symbols, sound signals, or light emission).

When the first magnetic-force generator 973 is provided in the door 45, the first magnetic-force generator 973 may vibrate simultaneously with the vibration of the tub 4. When the first magnetic-force generator 973 vibrates, the distance between the first magnetic-force generator 973 and the first magnetic-force sensor 971 varies, thus causing variation in the magnitude of magnetic force measured by the first magnetic-force sensor 971. Therefore, when the first magnetic-force generator 973 is provided in the door 45, the controller may incorrectly determine that the door 45 to open the introduction aperture 431 is opened even though the introduction aperture 431 is closed by the door 45.

To solve the problem described above, the controller may determine whether the magnetic force measured by the first magnetic-force sensor 971 is greater than or equal to the first reference magnetic force, and then may determine that the introduction aperture 431 is opened only when a state in which the measured magnetic force is the first reference magnetic force or more is continued during a predetermined reference time or more.

That is, the display unit 331*b* may display character signals or symbols, generate sound signals, or emit light only when the state in which the magnetic force measured by the first magnetic force sensor 971 is the first reference magnetic force or more is continued during the reference time or more.

The reference time may be set to a longer time than a time required to rotate the drum 5 once. For example, assuming the case where the drum 5 is set to be rotated at 30 RPM, the time required to rotate the drum 5 once is 2 seconds. When the drum 5 vibrates because laundry inside the drum 5 is not evenly distributed, the vibration of the drum 5 may be transmitted to the tub 4 whenever the drum 5 is rotated once. That is, the vibration of the drum 5 may be transmitted to the tub 4 during the period of time required to rotate the drum 5 once (i.e. 2 seconds). Accordingly, when the reference time is set to a longer time than the period during which the vibration of the drum 5 is transmitted to the tub 4 (2 seconds), it is possible to prevent the controller from from incorrectly determining that the door 45 is opened based on variation in magnetic force attributable to the vibration of the tub 4 or the door 45.

Figure 7:
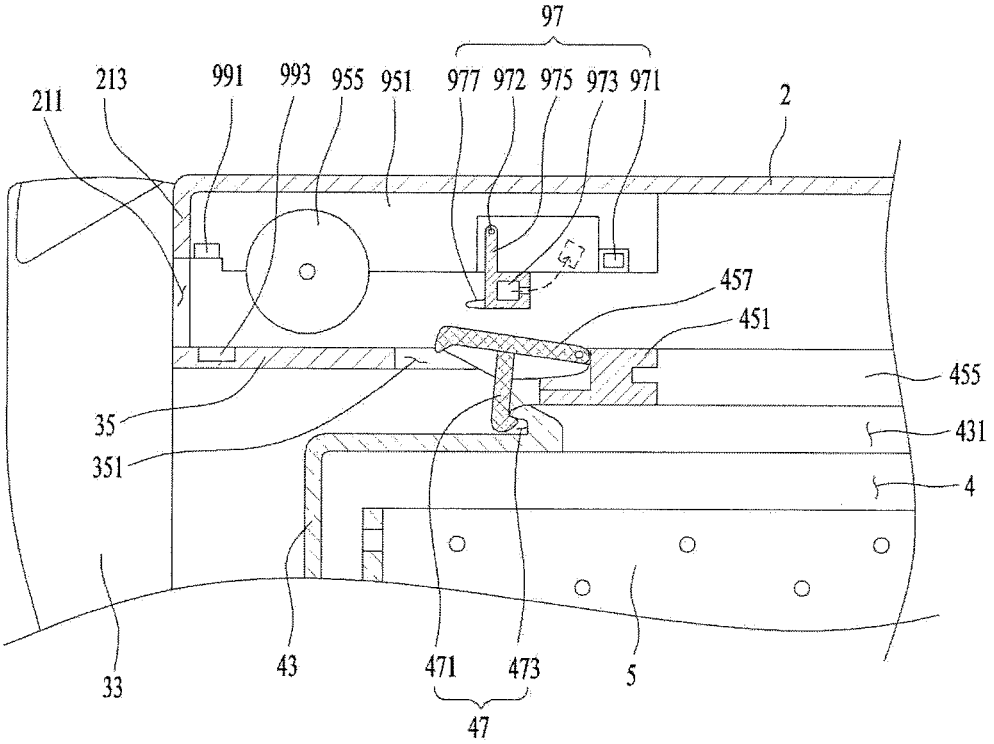
FIGS. 7 and 8 are views showing a first position sensing unit and a second position sensing unit.
Figure 8:
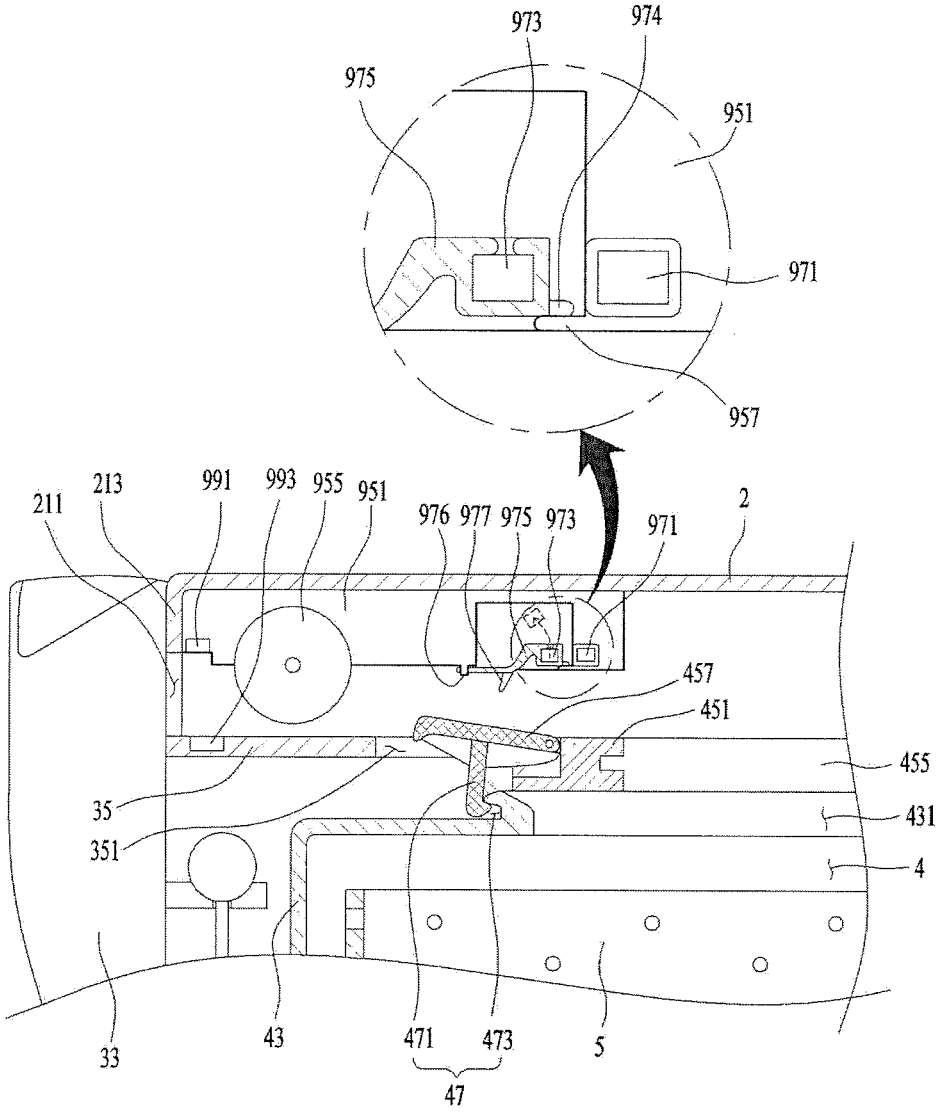

The occurence of incorrectly determining that the door 45 to open the introduction aperture 431 is opened even though the door 45 to open the introduction aperture 431 is closed may be reduced or eliminated using a first position sensing unit illustrated in FIGS. 7 and 8.

In the case of the first position sensing unit 97 illustrated in FIGS. 7 and 8, any one of the first magnetic-force sensor 971 and the first magnetic-force generator 973 is not provided in the door 45. Thus, even if the tub 4 or the door 45 vibrates, the magnetic force of the first magnetic-force generator 973 measured by the first magnetic-force sensor 971 may be maintained at a relatively constant value.

The first position sensing unit 97 of FIG. 7 may include the first magnetic-force sensor 971 provided in the case 951 for sensing magnetic force, a body 975 configured so as to be rotated toward the first magnetic-force sensor 971 when the door 45 to open the introduction aperture 431 is opened, and the first magnetic-force generator 973 fixed to the body 975.

The body 975 extends from the case 951 toward the door 45, and is rotatably coupled to the case 951 via a body rotating shaft 972. In addition, the first position sensing unit 97 may further include a contact portion 977, which protrudes from the body 975 toward the door 45 so as to come into contact with the door 45 when the door 45 to the introduction aperture 431 is opened.

When the door 45 to open the introduction aperture 431 is opened in the state in which the drawer 3 is inserted into the cabinet 2, the body 975 may be moved toward the first magnetic-force sensor 971 by the door 45, and therefore the magnetic force of the first magnetic-force generator 973 sensed by the first magnetic-force sensor 971 may be increased.

Accordingly, when the magnitude of magnetic force of the first magnetic-force generator 973, sensed by the first magnetic-force sensor 971, is the first reference magnetic-force or more, the controller may determine that the door 45 to open the introduction aperture 431 is opened. Upon determining that the door 45 to open the introduction aperture 431 is opened, the controller may notify the user that the door 45 is opened via the display unit 331*b*.

The first position sensing unit 97 of FIG. 8 may include the first magnetic-force sensor 971 fixed to the case 951 located above the door 45, the body 975 configured so as to be rotated away from the first magnetic-force sensor 971 when the door 45 to open the introduction aperture 431 is opened, and the first magnetic-force generator 973 fixed to the body 975.

The body 975 extends from the case 951 toward the first magnetic-force sensor 971. The body 975 may be rotatably fixed to the case 951 via a body rotating shaft. When the body 975 is formed of an elastic material, such as rubber, the body 975 may be fixed to the case 951 via a body fastening portion 976.

The body 975 may be provided with the body contact portion 977, which protrudes toward the door 45 so as to come into contact with the door 45 when the door 45 to open the introduction aperture 431 is opened.

In order to prevent the body 975 from being rotated toward the drawer 3 or the door 45, the case 951 may further be provided with a body support portion 957 for preventing the body 975 from being rotated toward the door 45. The body support portion 957 may be provided so as to directly support the body 975, and may be provided so as to support a body protruding portion 974 provided on the body 975.

In some implementations, the magnetic force of the first magnetic-force generator 973 measured by the first magnetic-force sensor 971 may become the maximum when the door 45 to open the introduction aperture 431 is closed, and may become the minimum when the door 45 to open the introduction aperture 431 is opened. Accordingly, the controller may determins that the door 45 to open the introduction aperture 431 is opened when the magnitude of magnetic force sensed by the first magnetic-force sensor 973 is below the first reference magnetic force.

Upon determining that the door 45 to open the introduction aperture 431 is opened, the controller may notify the user that the door 45 is opened via the display unit 331*b*. Therefore, the user may be notified of whether or not the current state is the state in which the door 45 to open the introduction aperture 431 is opened.

The laundry treatment apparatus 100 may further include a second position sensing unit 99 for determining whether or not the drawer 3 is inserted to the inside of the cabinet 2. The second position sensing unit may serve to determine whether or not the drawer 3 is located at a predetermined reference position. In one example, the reference position may be a position at which the introduction/discharge opening(an opening) 21 is closed by the drawer panel 33.

The second position sensing unit 99 may include a second magnetic-force generator 993 provided in any one of the drawer 3 and the cabinet 2 for generating magnetic-force, and a second magnetic-force sensor 991 provided in the other one of the drawer 3 and the cabinet 2 for sensing the magnitude of magnetic force provided by the second magnetic-force generator 993.

The second magnetic-force sensor 991 and the second magnetic-force generator 993 may be provided at positions at which whether or not the introduction/discharge opening (an opening) 21 is closed by the drawer panel 33 may be determined. FIG. 8 illustrates the case where the second magnetic-force generator 993 is a permanent magnet fixed to the front side of the drawer cover 35 and the second magnetic-force sensor 991 is fixed to the case 951 for sensing the magnitude of magnetic force of the permanent magnet.

When the drawer 3 is not completely inserted into the cabinet 2, but is operated, the drawer 3 may be discharged from the cabinet 2 by vibration generated during rotation of the drum 5.

To solve the problem described above, the controller may notify the user that the magnitude of magnetic force sensed by the second magnetic-force sensing unit 99 is smaller than a predetermined second reference magnetic-force via the display unit 331*b* (using character signals, symbols, sound signals, and light emission).

In addition, even if the user indicates the execution of a control command via the input unit 331*a*, the controller may delay the execution of a control command selected by the user until the magnitude of magnetic force sensed by the second magnetic-force sensing unit 99 becomes the second reference magnetic force or more.

As is apparent from the above description, the present invention has the effect of providing a laundry treatment apparatus may allow a drawer to be discharged from a cabinet even if a door to open an introduction aperture is opened in the state in which the drawer is inserted into the cabinet.

In addition, the present invention has the effect of providing a laundry treatment apparatus may notify a user that a door to open an introduction aperture is opened even through a drawer is inserted into a cabinet.

In addition, the present invention has the effect of providing a laundry treatment apparatus may determine whether or not a drawer is inserted into a cabinet and may notify the user of the result of the determination.

In addition, the present invention has the effect of providing a laundry treatment apparatus may include a sealing unit having a good effect of hermetically sealing an introduction aperture.

In addition, the present invention has the effect of providing a laundry treatment apparatus may prevent damage to a door when a drawer is discharged from a cabinet in the state in which the door is opened.

In addition, the present invention has the effect of providing a laundry treatment apparatus may sense that a door is opened when a drawer is inserted into a cabinet.

In addition, the present invention has the effect of providing a laundry treatment apparatus may determine the occurrence of abnormalities in constituent elements for determining whether or not a door is opened.

In addition, the present invention has the effect of providing a laundry treatment apparatus may reduce or eliminate the possibility of incorrectly determining a door to be opened even through the door is not opened.

What is claimed is:

1. A laundry treatment apparatus comprising:

a cabinet that defines an opening at a front surface of the cabinet;

a drawer configured to be discharged from the cabinet through the opening;

a through-hole defined in an upper surface of the drawer;

a tub that is located inside the drawer and that defines a space configured to receive water;

an introduction aperture defined in an upper surface of the tub and located under the through-hole;

a drum that is located in the tub, that is configured to rotate, and that is configured to receive laundry through the through-hole and the introduction aperture;

a door that is configured to open and close the introduction aperture, the door being coupled to one of the upper surface of the drawer or the upper surface of the tub by at least one hinge;

a flange that is located at the front surface of the cabinet, that protrudes toward the opening along the front surface of the cabinet, and that is configured to limit insertion of the drawer into the cabinet; and a guide configured to prevent interference between the door and the flange based on the drawer being discharged from the cabinet, wherein the guide includes a wheel that is located inside the cabinet and that is rotatably coupled to the cabinet, and wherein a distance from the upper surface of the drawer that defines the through-hole to a lowermost end of the wheel is shorter than a distance from the upper surface of the drawer that defines the through-hole to the flange.

2. The laundry treatment apparatus according to claim 1, wherein the guide includes a case that is fixed to the cabinet, and the wheel is rotatably coupled to the case.

3. The laundry treatment apparatus according to claim 2, wherein the wheel includes a first wheel and a second wheel that are spaced apart from each other by a predetermined distance in a direction along which the drawer is discharged.

4. The laundry treatment apparatus according to claim 1, further comprising a position sensing unit that is configured to determine one or both of i) whether the drawer is inserted into the cabinet to a predetermined reference position and ii) whether the door is opened during a state in which the drawer is inserted into the cabinet.

5. The laundry treatment apparatus according to claim 4, wherein the position sensing unit includes:

a first magnetic-force generator that is configured to generate magnetic force and that is located in one of the cabinet or the door; and a first magnetic-force sensor that is configured to sense a magnitude of the magnetic force generated by the first magnetic-force generator and that is located in the other of the cabinet and the door.

6. The laundry treatment apparatus according to claim 4, wherein the position sensing unit includes:

a first magnetic-force sensor that is configured to sense magnetic force and that is located inside the cabinet;

a body that is located inside the cabinet and that is configured to be rotated toward the first magnetic-force sensor based on the door being opened; and a first magnetic-force generator that is configured to generate magnetic force and that is coupled to the body.

7. The laundry treatment apparatus according to claim 4, wherein the position sensing unit includes:

a first magnetic-force sensor that is configured to sense magnetic force and that is located inside the cabinet;

a body that is located inside the cabinet and that is configured to be rotated away from the first magnetic-force sensor based on the door being opened; and a first magnetic-force generator that is configured to generate magnetic force and that is coupled to the body.

8. The laundry treatment apparatus according to claim 4, wherein the drawer includes a drawer body that is located inside the cabinet and that defines a space that is configured to receive the tub, and further includes a drawer panel that is configured to open and close the opening for discharging the drawer body from the cabinet, and wherein the position sensing unit is configured to determine whether the opening is closed by the drawer panel.

9. The laundry treatment apparatus according to claim 8, wherein the position sensing unit includes:

a second magnetic-force generator that is configured to generate magnetic force and that is located in one of the cabinet or the drawer; and a second magnetic-force sensor that is configured to sense a magnitude of the magnetic force generated by the second magnetic-force generator and that is located in the other of the cabinet or the drawer.

10. The laundry treatment apparatus according to claim 4, further comprising a display unit that is configured to notify a user that the drawer is inserted into the cabinet but not at the reference position, or that the door is opened during a state in which the drawer is inserted into the cabinet, or both.

11. The laundry treatment apparatus according to claim 10, wherein the display unit is configured to display characters or symbols, configured to generate sound, or configured to emit light.

12. The laundry treatment apparatus according to claim 11, wherein the display unit is an LCD.

13. The laundry treatment apparatus according to claim 11, wherein the display unit is a speaker.

14. The laundry treatment apparatus according to claim 11, wherein the display unit is a lamp.

15. The laundry treatment apparatus according to claim 1, wherein, based on the drawer being inserted into the cabinet, a distal end of the door is positioned vertically lower than a rotating shaft of the wheel.

16. The laundry treatment apparatus according to claim 3, wherein a first distance from the upper surface of the drawer to a lowermost end of the first wheel is different than a second distance from the upper surface of the drawer to a lowermost end of the second wheel.

17. The laundry treatment apparatus according to claim 16, wherein the second wheel is positioned closer to the opening than the first wheel, and wherein the second distance is shorter than the first distance.

18. A laundry treatment apparatus comprising:

a cabinet defining an opening at a front surface of the cabinet;

a drawer configured to be discharged from the cabinet through the opening;

a through-hole provided in an upper surface of the drawer;

a tub that is located inside the drawer and that defines a space configured to receive water;

an introduction aperture defined in an upper surface of the tub, the introduction aperture being located under the through-hole;

a drum that is located in the tub, that is configured to rotate, and that is configured to receive laundry through the through-hole and the introduction aperture;

a door that is configured to open and close the introduction aperture, the door being coupled to one of the upper surface of the drawer or the upper surface of the tub;

a flange that is located at the front surface of the cabinet, that protrudes toward the opening along the front surface of the cabinet, and that is configured to limit insertion of the drawer into the cabinet;

a guide configured to prevent interference between the door and the flange based on the drawer being discharged from the cabinet, wherein the drawer includes:

a drawer body that is located inside the cabinet and that defines a space configured to receive the tub, an upper surface of the drawer body defining the through-hole, and a drawer panel that is configured to open and close the opening for discharging the drawer body from the cabinet, wherein the guide includes a wheel that is located inside the cabinet and that is rotatably coupled to the cabinet, and wherein a distance from the upper surface of the drawer body that defines the through-hole to a lowermost end of the wheel is shorter than a distance from the upper surface of the drawer body that defines the through-hole to the flange.

19. The laundry treatment apparatus according to claim 1, further comprising a drawer cover that covers an upper side of the drawer and that defines the upper surface of the drawer.

20. The laundry treatment apparatus according to claim 1, wherein the upper surface of the drawer is an uppermost surface of the drawer.

* * * * *